US006573640B1

(12) United States Patent
Hakamata et al.

(10) Patent No.: US 6,573,640 B1
(45) Date of Patent: Jun. 3, 2003

(54) PHOTODETECTING DEVICE AND IMAGE SENSING APPARATUS USING THE SAME

(75) Inventors: Naotaka Hakamata, Hamamatsu (JP); Tadashi Maruno, Hamamatsu (JP); Motohiro Suyama, Hamamatsu (JP)

(73) Assignee: Hamamatsu Photonics K.K., Hamamatsu (JP)

( * ) Notice: Subject to any disclaimer, the term of this patent is extended or adjusted under 35 U.S.C. 154(b) by 0 days.

(21) Appl. No.: 09/574,217

(22) Filed: May 19, 2000

Related U.S. Application Data

(63) Continuation-in-part of application No. PCT/JP98/05179, filed on Nov. 18, 1998.

(30) Foreign Application Priority Data

Nov. 19, 1997 (JP) ..... 9-318489

(51) Int. Cl.[7] ..... H01J 1/10; H01J 61/52; H01J 40/06; H01J 40/20; H01K 1/58

(52) U.S. Cl. ..... 313/39; 313/40; 313/41; 313/523; 313/530; 313/542; 313/544; 250/214 R; 250/214 V; 250/338.1; 250/370.15

(58) Field of Search ..... 250/214 R, 214 V, 250/338.1, 370.15; 313/39, 40, 41, 47, 542, 544, 523, 530

(56) References Cited

U.S. PATENT DOCUMENTS

| | | | | |
|---|---|---|---|---|
| 3,781,469 A | * | 12/1973 | Donjon et al. | 250/214 VT |
| 3,881,104 A | * | 4/1975 | Donjon et al. | 250/214 VT |
| 4,178,529 A | | 12/1979 | Kennedy | 313/102 |
| 4,464,572 A | | 8/1984 | Hirschfeld | 250/338 |
| 5,485,005 A | | 1/1996 | Aikens | 250/214 |

FOREIGN PATENT DOCUMENTS

| | | | | |
|---|---|---|---|---|
| EP | 0 565 366 A | | 10/1993 | |
| FR | 02481521 A | * | 8/1981 | H01J/29/45 |
| JP | 49-106380 | | 10/1974 | |
| JP | 59-080056 | | 8/1984 | |
| JP | 63-019978 | | 6/1988 | |
| JP | 6-021519 | | 1/1994 | |
| JP | 6-216402 | | 8/1994 | |
| JP | 6-243795 | | 9/1994 | |
| JP | 8-017390 | | 1/1996 | |
| JP | 08122683 A | * | 5/1996 | G02B/26/10 |
| JP | 8-190889 | | 7/1996 | |
| JP | 8-107526 | | 8/1996 | |
| JP | 8-255921 | | 10/1996 | |
| JP | 9-162379 | | 6/1997 | |
| JP | 9-199075 | | 7/1997 | |
| JP | 10041489 A | * | 2/1998 | H01L/27/14 |
| JP | 10-256613 | | 12/1998 | |

* cited by examiner

*Primary Examiner*—Nimeshkumar D. Patel
*Assistant Examiner*—Mariceli Santiago
(74) *Attorney, Agent, or Firm*—Morgan, Lewis & Bockius LLP

(57) ABSTRACT

A photodetecting device is characterized by comprising a photodetecting section having a photoelectric surface for emitting photoelectrons upon incidence of light, a semiconductor detection element having an electron incident surface on which the photoelectrons can be incident, and a vacuum vessel in which the photoelectric surface is arranged on one inner surface, and the semiconductor detection element is arranged on the other inner surface opposing the one surface, and cooling means for cooling a structure on the semiconductor detection element side of the vacuum vessel.

8 Claims, 8 Drawing Sheets

PHOTODETECTING DEVICE AND IMAGE SENSING APPARATUS USING THE SAME

RELATED APPLICATION

This is a continuation-in-part application of application serial no. PCT/JP98/05179 filed on Nov. 18, 1998, now pending.

BACKGROUND OF THE INVENTION

1. Field of the Invention

The present invention relates to a photodetecting device having a photodetecting section including a photoelectric surface for converting incident light into photoelectrons and a semiconductor detection element for detecting the photoelectrons emitted from the photoelectric surface, and an image sensing apparatus using the photodetecting device.

2. Related Background Art

Conventionally, a vacuum tube type photodetecting device is known which has a photodetecting section having a photoelectric surface for emitting photoelectrons upon incidence of light and an electron incidence type semiconductor detection element for converting the photoelectrons emitted from the photoelectric surface into a signal voltage. As an example of a photodetecting device of this type, an electron tube is disclosed in Japanese Patent Laid-Open No. 6-243795. The electron tube disclosed in this prior art has a photoelectric surface and a back irradiation type CCD opposing the photoelectric surface. This electron tube can detect weak light or UV light, unlike a camera which has no photoelectric surface and makes light directly incident on a semiconductor detection element such as a CCD.

In recent years, however, demand has arisen for further improvement of the photodetecting efficiency of photodetecting devices represented by the electron tube disclosed in Japanese Patent Laid-Open No. 6-243795, which has a photodetecting section including a photoelectric surface and an electron incidence type semiconductor detection element.

SUMMARY OF THE INVENTION

The present invention has been made in consideration of the above situation, and has as its object to provide a photodetecting device with an improved photodetecting efficiency and an image sensing apparatus using the photodetecting device.

To achieve this object, the present inventors have completed the present invention with an emphasis on a technique of reducing a dark current flowing to the photoelectric surface and the semiconductor detection element such as a CCD.

A photodetecting device according to the present invention is characterized by comprising a photodetecting section having a photoelectric surface for emitting photoelectrons upon incidence of light, a semiconductor detection element having an electron incident surface on which the photoelectrons can be incident, and a vacuum vessel in which the photoelectric surface is arranged on one inner surface, and the semiconductor detection element is arranged on the other inner surface opposing the one surface, and cooling means for cooling a structure on the semiconductor detection element side of the vacuum vessel.

In the photodetecting device of the present invention, when measurement light becomes incident on the photoelectric surface, photoelectrons are emitted. When the photoelectrons are incident on the electron incident surface of the semiconductor detection element, the incident light is detected. In the present invention, the structure on the semiconductor detection element side of the vacuum vessel is cooled, and therefore, a dark current in the semiconductor detection element is suppressed. Not only the semiconductor detection element but also the photoelectric surface is cooled through the vacuum vessel in which the semiconductor detection element and photoelectric surface are arranged. Hence, a dark current in the photoelectric surface is also suppressed, and the photodetecting efficiency is improved.

In the photodetecting device of the present invention, preferably, the cooling means has an absorption portion for absorbing heat and a heat generation portion for generating heat, and the heat absorption portion is arranged on the semiconductor detection element side of the vacuum vessel. As such cooling means, a Peltier element is preferably used.

When this arrangement is employed, for example, the absorption portion of the cooling means such as a Peltier element absorbs heat of the semiconductor detection element. The semiconductor detection element is cooled, and the dark current is suppressed. Not only heat of the semiconductor detection element but also heat of the photoelectric surface is absorbed by the absorption portion of the cooling means through the vacuum vessel. The photoelectric surface is cooled, and the dark current is suppressed.

Preferably, the photodetecting device further comprises a housing which comprises a transparent portion capable of passing the light to be incident on the photoelectric surface, and a voltage introduction terminal capable of supplying, to the photodetecting section, a voltage to be applied between the photoelectric surface and the electron incident surface, and accommodates at least part of the vacuum vessel, and the heat generation portion of the cooling means is fixed at a predetermined position on an inner surface of the housing.

When this arrangement is employed, for example, incident light transmitted through the transparent portion made of glass reaches the photoelectric surface, and photoelectrons are generated by the photoelectric surface. When a voltage is applied between the photoelectric surface and the electron incident surface from a voltage supply source outside the housing through the voltage introduction terminal, the photoelectrons generated by the photoelectric surface are attracted by the electron incident surface. With this operation, the incident light is detected. In addition, since the heat generation portion of the cooling means is fixed at a predetermined position on an inner surface of the housing, heat generated by the heat generation portion of the cooling means is transmitted to the transparent portion through the housing. For this reason, the transparent portion is not excessively cooled, and condensation on the transparent portion is prevented. Hence, the efficiency of measurement light reaching the photoelectric surface, and more specifically, the photodetecting efficiency of the photodetecting device is improved.

When the arrangement with the housing having the transparent portion and voltage introduction terminal is employed, the housing preferably further comprises a vacuum port for setting a vacuum state in the housing.

In this case, the vacuum state is set in the housing by exhausting the gas from the housing through the vacuum port using a vacuum pump or the like. When the vacuum state is set in the housing, the cooling efficiency of the photoelectric surface and semiconductor detection element is improved, and discharge between the voltage introduction terminal and the housing can be prevented.

When the arrangement with the housing having the transparent portion and voltage introduction terminal is employed, the housing preferably further comprises a gas introduction port for introducing and sealing a dry inert gas having a pressure lower than atmospheric pressure in the housing.

In this case, since the gas sealed in the housing is a dry gas, condensation in the housing is prevented. Hence, the efficiency of incident light reaching the photoelectric surface is prevented from lowering due to condensation. Additionally, since the gas is an inert gas with a pressure lower than atmospheric pressure, discharge between the voltage introduction terminal and the housing can be prevented.

The housing further preferably further comprises radiation means for radiating heat, the radiation means being arranged at the predetermined position where the heat generation portion of the cooling means is fixed.

When this arrangement is employed, heat generated by the heat generation portion of the cooling means is externally radiated from the housing by the radiation means. Hence, the cooling efficiency of the vacuum vessel is improved, and the dark current flowing to the photoelectric surface and semiconductor detection element is further reduced.

The vacuum vessel may comprise an incident surface plate which passes the light and has the photoelectric surface arranged on one surface, a detection element fixing plate opposing the incident surface plate and having the semiconductor detection element arranged thereon, and a side tube which forms a vacuum space together with the incident surface plate and the detection element fixing plate.

When this arrangement is employed, the semiconductor detection element is cooled by the vacuum vessel through the detection element fixing plate. Since the incident surface plate on which the photoelectric surface is arranged is connected to the detection element fixing plate through the side tube, not only the semiconductor detection element but also the photoelectric surface is cooled by thermal conduction.

Especially, when the side tube and detection element fixing plate are formed from a ceramic material having a high thermal conductivity, the thermal conductivity is improved, and the photoelectric surface can be easily cooled as the semiconductor detection element is cooled.

DESCRIPTION OF THE PREFERRED EMBODIMENTS

Figure 1:
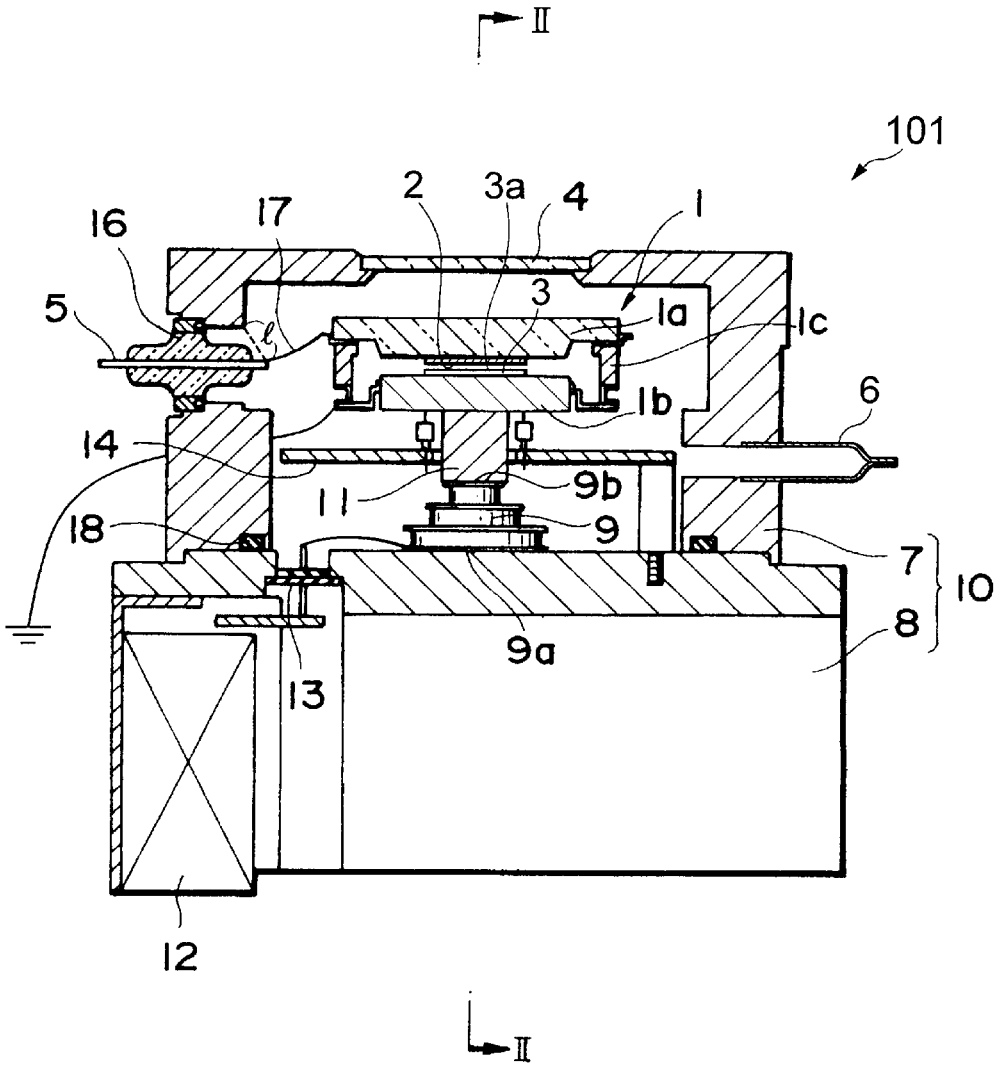
FIG. 1 is a sectional view of a photodetecting device according to the first embodiment.

Preferred embodiments of a photodetecting device according to the present invention will be described below in detail with reference to the accompanying drawings. The same reference numerals denote the same elements throughout the drawings, and a repetitive description thereof will be omitted.

First Embodiment

Figure 2:
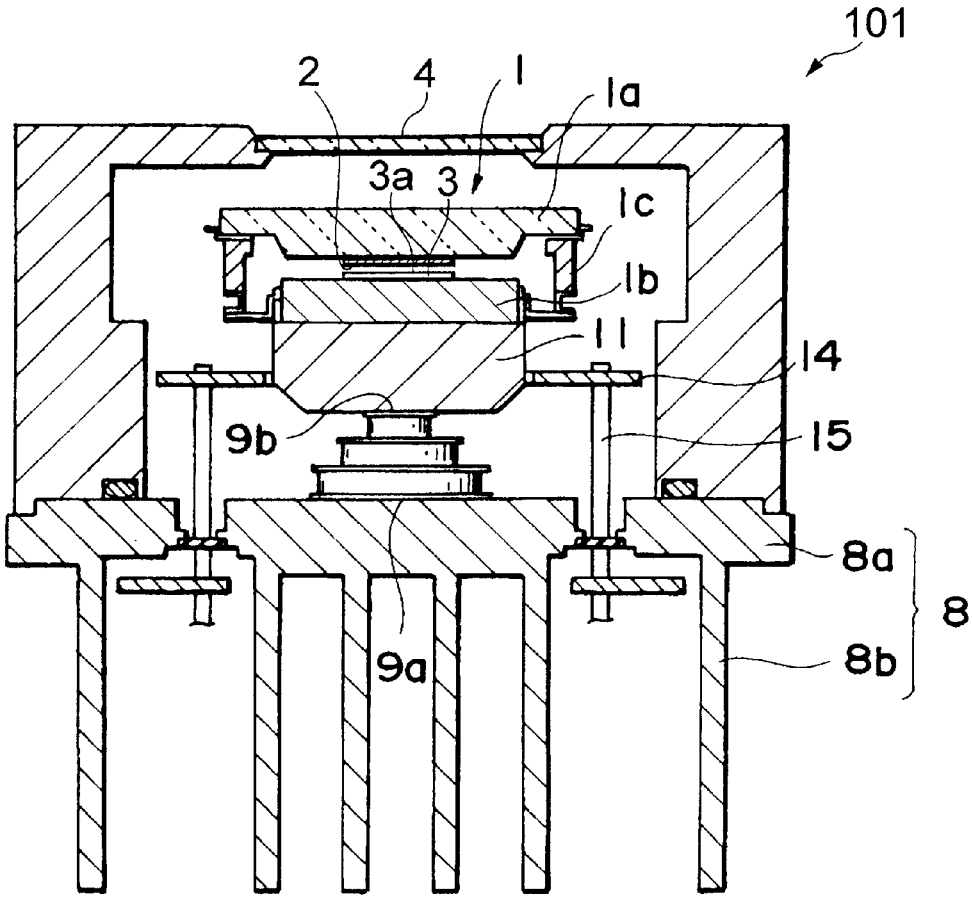
FIG. 2 is a sectional view of the photodetecting device shown in FIG. 1, which is taken along a line II—II.

The arrangement of a photodetecting device according to the first embodiment of the present invention will be described first with reference to FIGS. 1 and 2. FIG. 1 is a sectional view of an entire photodetecting device 101. FIG. 2 is a sectional view taken along a line II—II of the photodetecting device 101 shown in FIG. 1. This photodetecting device 101 mainly comprises a hermetic vessel 10 constituted by a housing 7 made of stainless steel and radiator 8, a photodetecting section 1 accommodated in the hermetic vessel 10, and Peltier elements 9 as cooling means installed in the hermetic vessel 10.

On the upper surface of the housing 7, i.e., on the measurement light incidence side, a transparent member 4 made of glass is hermetically fixed to the housing 7 with an adhesive. On the side surface of the housing 7, a high-voltage introduction terminal 5 which is made of Kovar and supplies a high voltage to the photodetecting section 1 is hermetically fixed to the housing 7 through an insulting member 16 formed from glass such that one end of the terminal externally projects outside the hermetic vessel 10 while the other end is accommodated in the hermetic vessel 10. To prevent damage, the insulting member 16 uses glass having almost the same thermal expansion coefficient as that of Kovar that forms the high-voltage introduction terminal 5. One end of the high-voltage introduction terminal 5, which is located in the hermetic vessel 10, is electrically connected to a photoelectric surface 2 of the photodetecting section 1 through a conductor wire 17.

On the side surface of the housing 7, a gas introduction port 6 which is made of copper and introduces a dry inert gas into the hermetic vessel 10 is hermetically inserted into the housing 7. The housing 7 is attached to the radiator 8 which also functions as a base member through a vacuum sealing member such as an O-ring, thereby forming the hermetic vessel 10. The radiator 8 is formed from a material having a high thermal conductivity (e.g., aluminum) and has radiation fins 8*b* suspending from a base portion 8*a*, as shown in FIG. 2. An air cooling fan 12 for cooling the radiator 8 by air is provided outside the radiator 8. A Peltier power supply connector 13 is in tight contact with the side portion of the base portion 8*a*.

A multiple of Peltier elements 9 as cooling elements are stacked on the upper surface of the radiator 8, i.e., in the hermetic vessel 10. A Peltier element 9 on the lower side in FIG. 1, i.e., on the radiator 8 side serves as a heat generation portion 9*a*, and a Peltier element 9 on the upper side serves as a heat absorption portion 9*b*. The Peltier element 9 on the heat generation portion 9*a* side is connected to the above-described Peltier power supply connector 13. The photodetecting section 1 is mounted on the upper surface of the heat absorption portion 9*b* through an aluminum member 11 having a high thermal conductivity. The aluminum member 11 need not always be provided.

The photodetecting section 1 is a vessel in which a vacuum space is formed by a disc-like stem 1*b*, cylindrical valve 1*c*, and incident surface plate 1*a* made of glass. The stem 1*b* and valve 1*c* are formed from a ceramic with satisfactory thermal conductivity and electrical insulating properties.

The incident surface plate 1*a* of the photodetecting section 1 has, on its lower surface, the above-described photoelectric surface 2 which emits photoelectrons upon receiving measurement light transmitted through the transparent member 4. The stem 1*b* has, on its upper surface, a back irradiation type CCD 3 for converting the photoelectrons emitted from the photoelectric surface 2 into a signal voltage. The CCD 3 has an electron incident surface 3*a*. The electron incident surface 3*a* opposes the photoelectric surface 3. A circuit board 14 for processing a signal from the CCD 3 is connected to the CCD 3. A signal connector 15 shown in FIG. 2 is connected to the circuit board 14. The electron incident surface 3*a* of the CCD 3 is set at ground potential.

The photodetecting device 101 of this embodiment is completed by introducing and sealing a dry inert gas in the above-described hermetic vessel 10. The gas is introduced and sealed in the hermetic vessel 10 in the following way. First, air in the hermetic vessel 10 is exhausted from the gas introduction port 6 using a turbo-pump to set a high-vacuum state in the hermetic vessel 10. After that, a dry inert gas (not shown) is introduced from the gas introduction port 6 into the hermetic vessel 10. Then, the gas introduction port 6 is cut by pinch-off to make the cut portion flat and maintain the hermetic state, as shown in FIG. 1, or closed by a valve (not shown), thereby sealing the hermetic vessel 10.

As described above, since a high voltage is applied to the photodetecting section 1, discharge may occur between the conductor wire 17 and the housing 7 to generate a dark current in the photoelectric surface 2. However, the dark current in the photoelectric surface 2 can be prevented by setting the sealed gas at such pressure that no discharge occurs between the conductor wire 17 and the housing 7.

The pressure of the gas sealed in the hermetic vessel 10 is preferably within the range from 100 Torr to atmospheric pressure.

If the gas pressure is much lower than the lower limit of the above-described range, discharge readily occurs between the housing 7 and the conductor wire 17 in the hermetic vessel 10. The reason is as follows.

Figure 3:
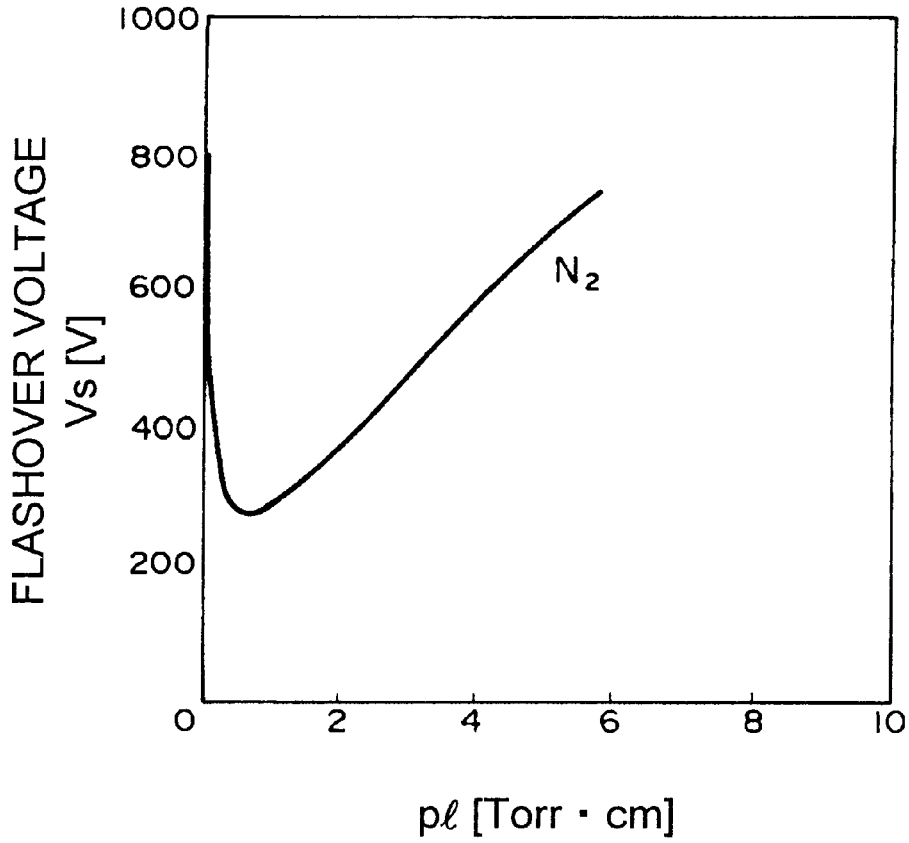
FIG. 3 is a graph showing the relationship between the gas pressure and the flashover voltage.

As indicated by the Paschen's curve in FIG. 3, let p [Torr] be the gas pressure, and l [cm] be the minimum distance between the housing 7 and the conductor wire 17 of the high-voltage introduction terminal 5. A flashover voltage Vs [V] is represented by a function of pl [Torr. cm] and exhibits an almost V-shaped curve. When the value pl is about 1 [Torr. cm], the flashover voltage Vs [V] is minimum. The tendency of the graph changes from this minimum point. In this embodiment, since the distance 1 is about 0.7 cm, only a region where the value pl is larger than 1 [Torr. cm] need be taken into consideration. In this region, as the value pl becomes small, i.e., as the gas pressure becomes low, the flashover voltage Vs [V] becomes low to readily cause discharge. When the gas pressure is reduced, the molecule density of the sealed gas becomes low. The average free path of electrons becomes long, so the electrons in the field are accelerated to increase the speed. For this reason, collision ionization becomes active, and discharge readily occurs.

On the other hand, if the gas pressure is much higher than the upper limit of the above-described range, heat convection occurs in the hermetic vessel 10. This degrades the cooling effect for the CCD 3 and photoelectric surface 2 and lowers the photodetection efficiency of the photodetecting section 1. In addition, the sealed gas presses the transparent member 4 made of glass.

Hence, when the pressure of the sealed gas is set within the range from 100 Torr to atmospheric pressure, the cooling efficiency can be prevented from becoming low, and discharge can be more properly prevented. However, since the probability of discharge changes depending on the magnitude of the voltage applied to the photodetecting section 1, the pressure of sealed gas must be determined in accordance with the applied voltage.

The function of the photodetecting device of this embodiment will be described next in units of the cooling process and photodetection process of the photodetecting section.

The cooling process of the photodetecting section 1 will be described first with reference to FIG. 1.

When a current flows from the Peltier power supply connector 13 to the Peltier elements 9, the Peltier element 9 on the heat absorption side absorbs heat of the CCD 3 through the aluminum member 11 having a high thermal conductivity and cools the CCD 3. For this reason, the dark current flowing to the transfer section of the CCD 3 decreases, and the sensitivity of the CCD 3 is improved. Since a high voltage is applied to the photodetecting section 1, the temperature of the photoelectric surface 2 increases without the Peltier elements 9. Unwanted thermoelectrons may be emitted from the photoelectric surface 2 to increase the dark current. In this embodiment, however, since the Peltier elements 9 are provided to cool not only the CCD 3 but also the photoelectric surface 2 through the stem 1*b* and valve 1*c* which are formed from a ceramic having a satisfactory thermal conductivity, thermoelectrons can be reduced, and the sensitivity of the photoelectric surface 2 can be improved. Since a portion near the incident surface plate 1*a* is cooled, condensation may occur on the incident surface plate 1*a*. However, the gas sealed in the hermetic vessel 10 is a dry gas, and therefore, no condensation occurs on the incident surface plate 1*a*. For this reason, the efficiency of measurement light transmitted through the transparent member 4 and incident on the photoelectric surface 2 can be prevented from lowering.

Heat of the heat generation portion 9*a* of the Peltier elements 9 is externally radiated from the photodetecting device 101 by the radiator 8. The air cooling fan 12 is arranged near the radiator 8 to further increase the cooling effect of the radiator 8 and, more particularly, the cooling effect for the CCD 3 and photoelectric surface 2, thereby improving the photodetecting effect. The heat of the heat generation portion 9*a* of the Peltier elements 9 is transferred to the transparent member 4 through the housing 7 made of stainless steel. Since this prevents condensation on the transparent member 4, the efficiency of measurement light incident on the photoelectric surface 2 can be improved.

In addition, since the high-vacuum state in the hermetic vessel 10 need not always be maintained in cooling, a vacuum pump can be omitted. For this reason, the entire apparatus can be made compact for easy handling, and the manufacturing cost can also be reduced.

The gas sealed in the hermetic vessel 10 is dry nitrogen gas. Alternatively, argon or xenon gas may be sealed. When argon or xenon gas is used, transmission of external heat of the hermetic vessel 10 by convection decreases because these gases have lower thermal conductivities than the thermal conductivity of nitrogen, and therefore, the cooling efficiency for the photodetecting section 1 is improved.

Figure 4:
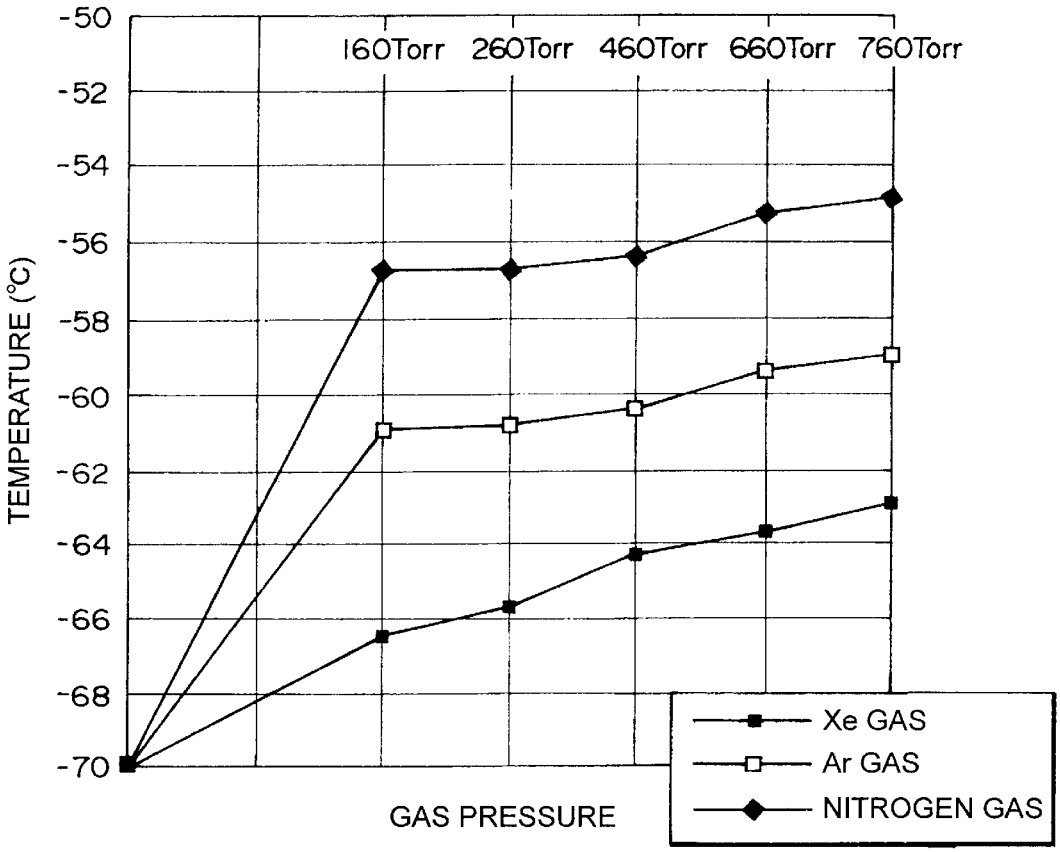
FIG. 4 is a graph showing the relationship between the type of gas and the cooling temperature.

FIG. 4 shows the result of an experiment in which an experimental apparatus having Peltier elements accommodated in a hermetic vessel was prepared independently of this embodiment, and the temperature of the heat absorption portion of the Peltier elements to which a current of 0.8 A was flowed was measured for each of nitrogen, argon, and xenon gases. As is apparent from this graph, the highest cooling effect is obtained when xenon with the lowest thermal conductivity is used.

Figure 5:
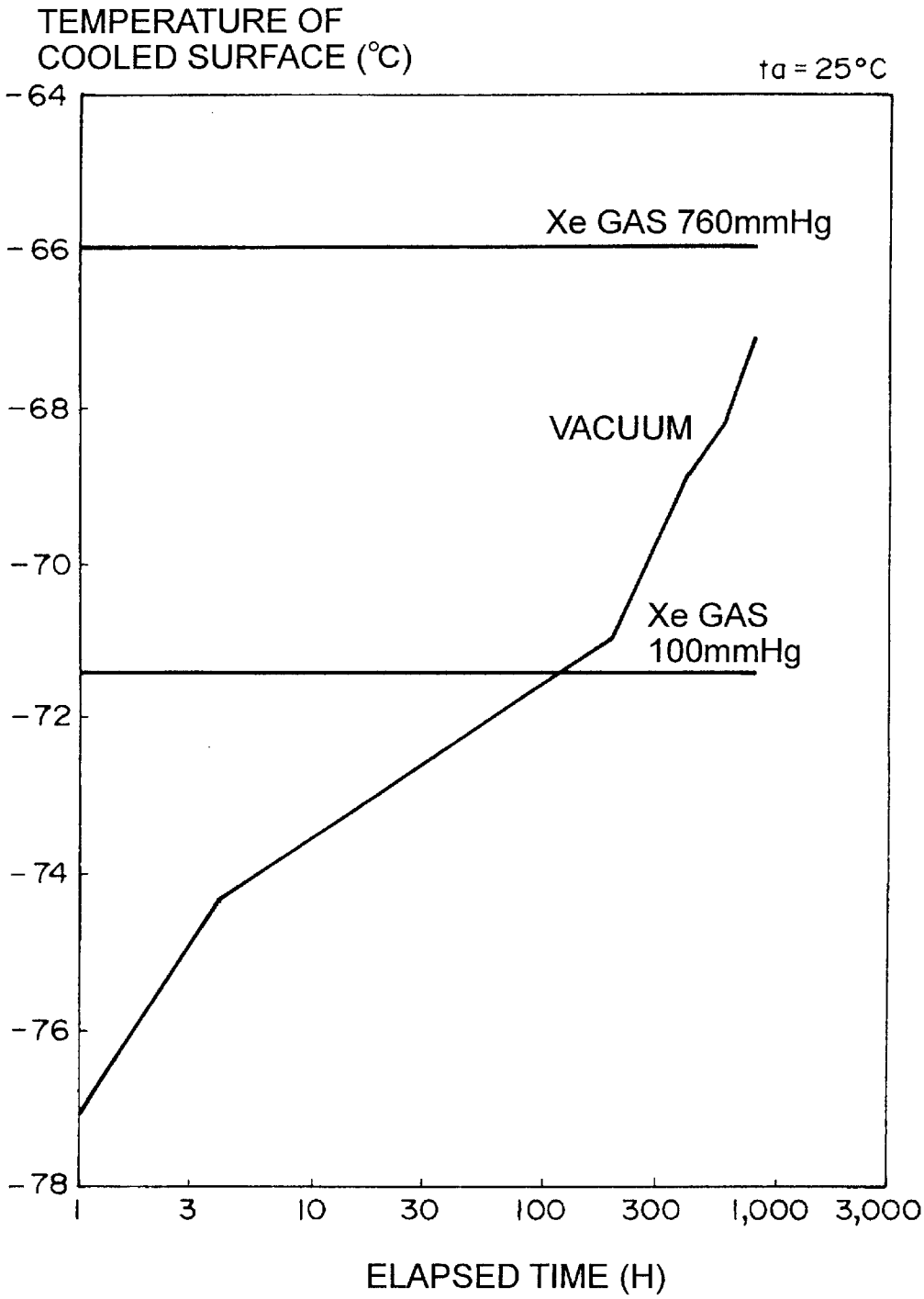
FIG. 5 is a graph showing the relationship between the elapsed time and the cooling temperature when xenon gas is sealed.

FIG. 5 shows the result of an experiment in which a change in temperature of the heat absorption portion of Peltier elements along the time axis when xenon gas is sealed in the hermetic vessel was measured. As is apparent from this graph, even when the time has elapsed, the cooling effect rarely degrades. As described above, when xenon gas is used, the cooling effect of the Peltier elements 9 can be improved and maintained for a long time. However, to give priority to cost reduction, nitrogen gas is preferably used rather than xenon gas.

The photodetection process of the photodetecting device 101 whose photodetecting efficiency is improved by the above cooling process will be described next with reference to FIG. 1.

When target measurement light is transmitted through the transparent member 4 and the incident surface plate 1*a* of the photodetecting section 1 and becomes incident on the photoelectric surface 2, electrons in the photoelectric surface 2 are excited upon absorbing the photon energy [hv] and emitted into the vacuum as photoelectrons. When a high voltage of about −8 kV is applied from an external high-voltage power supply to the photoelectric surface 2 through the high-voltage introduction terminal 5, the photoelectrons emitted from the photoelectric surface 2 are attracted to the CCD 3 side because the electron incident surface 3*a* of the CCD 3 is grounded. The photoelectrons attracted to the CCD 3 side reach the CCD 3 and are converted into signal charges, and then, converted into a signal voltage by the output section of the CCD 3. The signal voltage is processed by the circuit board 14 and output through the signal connector 15.

Since the photoelectric surface 2 and CCD 3 are cooled by the Peltier effect of the Peltier elements 9 to increase the sensitivity, weak light or UV light can be detected, unlike a conventional photodetecting device which has a photoelectric surface without a cooling unit, and an electron incidence type semiconductor element. Even when a high voltage is applied to the photodetecting section 1, no dark current is generated in the photoelectric surface 2 due to the influence of discharge because an inert gas is sealed in the hermetic vessel 10 at a pressure lower than atmospheric pressure and, more specifically, such a pressure that no discharge occurs. For this reason, the high sensitivity state of the photodetecting section 1 by the cooling function of the Peltier elements 9 is rarely damaged.

Second Embodiment

Figure 6:
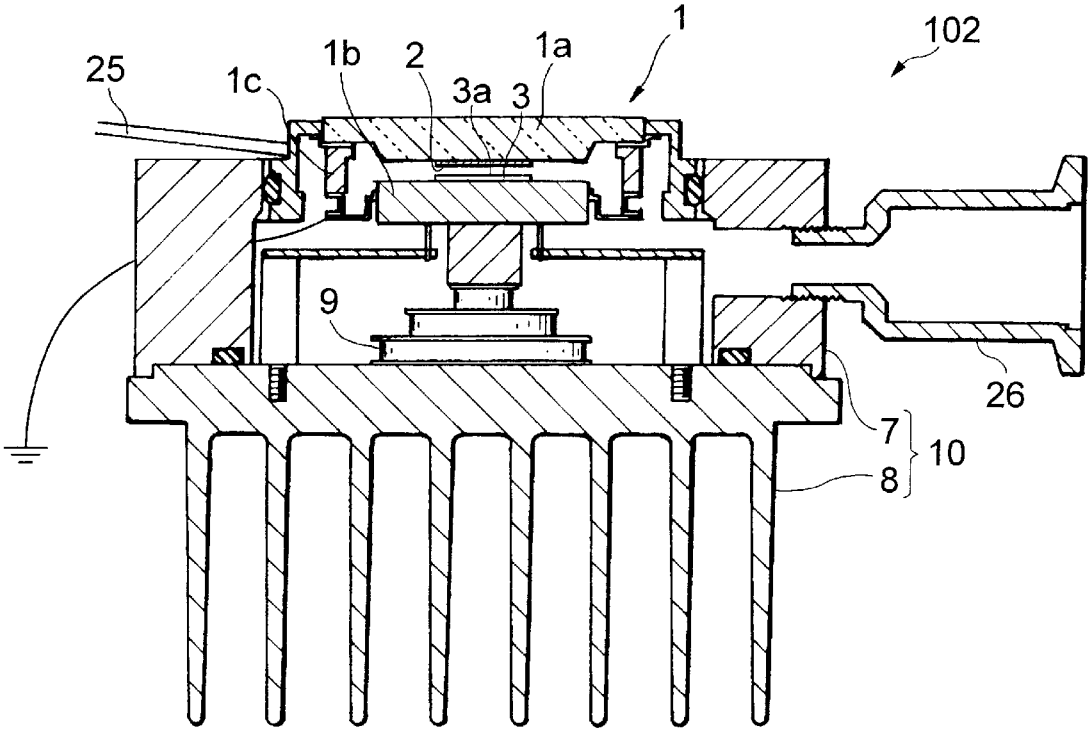
FIG. 6 is a sectional view of a photodetecting device according to the second embodiment.

A photodetecting device according to the second embodiment of the present invention will be described next with reference to FIG. 6. A photodetecting device 102 of this embodiment is different from a photodetecting device 101 of the first embodiment in that an incident surface plate 1*a* of a photodetecting section 1 is in contact with air, a high-voltage cable 25 projecting outside a hermetic vessel 10 is provided instead of the high-voltage introduction terminal 5 and conductor wire 17 as a mechanism for applying a voltage to a photoelectric surface 2, and a vacuum port 26 for setting a vacuum state in the hermetic vessel 10 is arranged in place of the gas introduction port 6. When the photodetecting device 102 is operating, air in the hermetic vessel 10 is exhausted from the vacuum port 26 by a vacuum pump (not shown), so the vacuum state is set in the hermetic vessel 10.

In this embodiment as well, a CCD 3 and photoelectric surface 2 are cooled by the function of Peltier elements 9, and the photodetecting efficiency can be improved, as in the first embodiment. In addition, since the-high-voltage cable 25 for applying a voltage to the photoelectric surface 2 projects into air, no discharge occurs in the hermetic vessel 10. Furthermore, since the degree of vacuum can be increased, the cooling efficiency can be improved.

The first embodiment is more practical than the second embodiment because condensation may occur on the air-side surface of the incident surface plate 1*a* of the photodetecting section 1 when cooled, and the entire apparatus becomes bulky due to the vacuum pump which is always provided.

Third Embodiment

Figure 7:
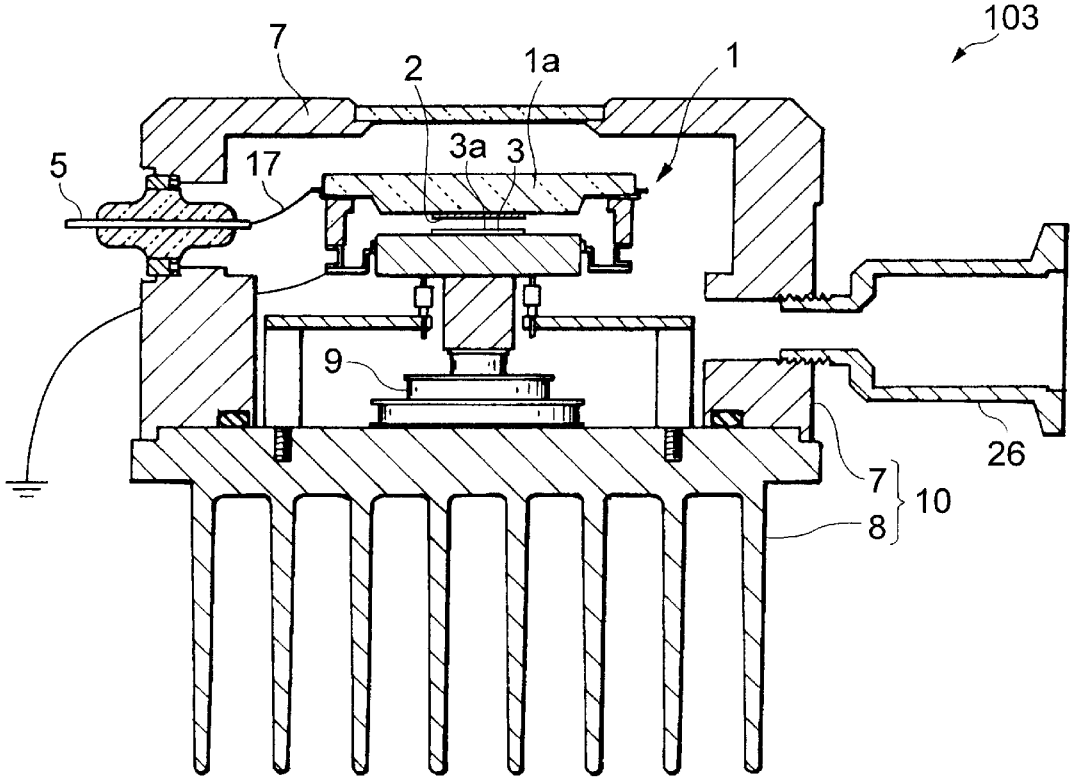
FIG. 7 is a sectional view of a photodetecting device according to the third embodiment.

A photodetecting device according to the third embodiment of the present invention will be described next with reference to FIG. 7. A photodetecting device 103 of this embodiment is different from a photodetecting device 101 of the first embodiment in that a vacuum port 26 for setting the vacuum state in a hermetic vessel 10 is formed in place of the gas introduction port 6. When the photodetecting device 103 is operating, air in the hermetic vessel 10 is exhausted from the vacuum port 26 by a vacuum pump (not shown), so the vacuum state is set in the hermetic vessel 10.

In this embodiment as well, a CCD 3 and photoelectric surface 2 are cooled by the function of Peltier elements 9, and the photodetecting efficiency can be improved, as in the first embodiment. In addition, since the degree of vacuum can be increased, the cooling efficiency can be improved.

The third embodiment is more practical than the second embodiment because condensation does not occur on the upper surface of an incident surface plate 1*a,* i.e., the surface on the side without the photoelectric surface 2. However, the first embodiment is more practical than the third embodiment because the entire apparatus becomes bulky due to the vacuum pump which is always provided.

Image Sensing Apparatus

A CCD camera 111 as an image sensing apparatus having a photodetecting device 101 of the first embodiment will be described next.

Figure 8:
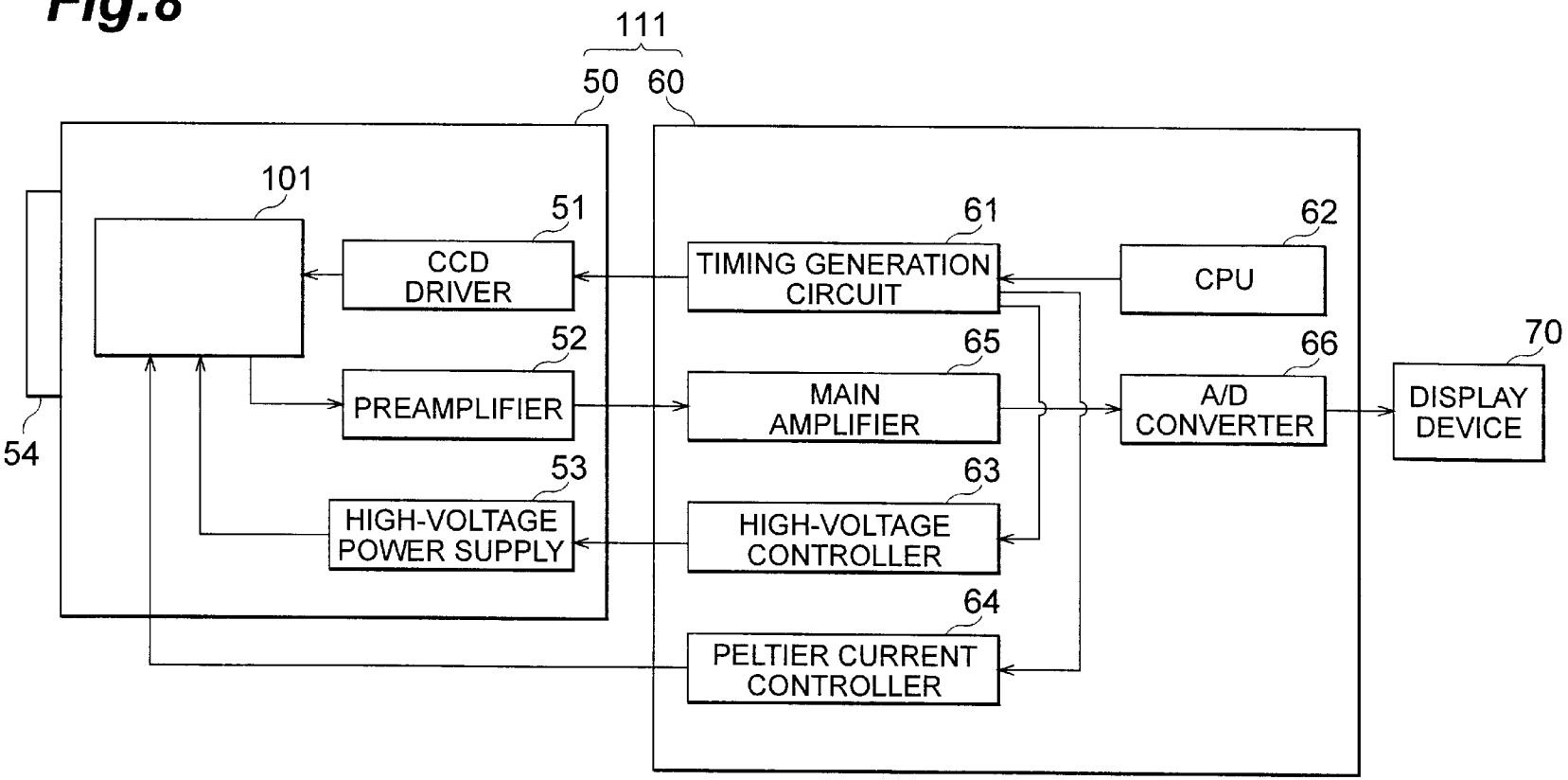
FIG. 8 is a view showing the arrangement of a CCD camera as an image sensing apparatus.

FIG. 8 is a block diagram of the CCD camera 111. The aluminum member 11 comprises a camera head 50 incorporating the photodetecting device 101 of the first embodiment and a camera controller 60 for controlling the photodetecting device 101. The camera head 50 accommodates not only the photodetecting device 101 but also a CCD driver 51 for driving a CCD 3 in the photodetecting device 101, a preamplifier 52 for amplifying the output from the CCD 3, and a high-voltage power supply 53 for applying a high voltage to a photoelectric surface 2 in the photodetecting device 101 through a high-voltage introduction terminal 5. A condenser lens 54 is arranged on the incidence side of the photodetecting device 101.

The camera controller 60 has a timing generation circuit 61 for outputting a timing signal for controlling the CCD driver 51, a CPU 62 for controlling the timing generation circuit 61, and a high-voltage controller 63 for controlling the high-voltage power supply 53, a Peltier current controller 64 for controlling a current of Peltier elements 9 in the photodetecting device 101, a main amplifier 65 for amplifying the output from the preamplifier 52, and an A/D converter 66 for converting the output from the main amplifier 65 into a digital signal. The A/D converter 66 is connected to an external display device 70 having a control function.

In this arrangement, an output signal read from the CCD 3 of the photodetecting device 101 is amplified by the preamplifier 52 and main amplifier 65, sent to the A/D converter 66, and then converted into a digital signal. After that, the signal is transmitted to the external display device 70 having a control function, subjected to predetermined signal processing, and displayed on the display device. The CCD camera 111 incorporates the photodetecting device 101 with a high photodetectinq efficiency and therefore has a very high sensitivity.

An image sensing apparatus having the photodetecting device 101 of the first embodiment has been described above. A photodetecting device 102 of the second embodiment or a photodetecting device 103 of the third embodiment can also be used.

The invention made by the present inventors has been described above in detail on the basis of the embodiments. However, the present invention is not limited to the above embodiments. For example, the arrangement of the CCD camera 111 can be appropriately changed.

As has been described above, in the photodetecting device of the present invention, the semiconductor detection element side of the vacuum vessel is cooled, and a dark current in the semiconductor detection element is suppressed. In addition, not only the semiconductor detection element but also the photoelectric surface is cooled through the vacuum vessel in which the semiconductor detection element and photoelectric surface are arranged. For this reason, a dark current in the photoelectric surface is also suppressed, and the photodetecting efficiency is improved.

What is claimed is:

1. A photodetecting device comprising:

a photodetecting section having a photoelectric surface for emitting photoelectrons upon incidence of light, a semiconductor detection element having an electron incident surface on which the photoelectrons can be incident, and a vacuum vessel in which said photoelectric surface is arranged on one inner surface, said semiconductor detection element being arranged on another inner surface opposing said one inner surface;

cooling means for cooling a structure on said semiconductor detection element side of said vacuum vessel, said cooling means having a heat absorption portion for absorbing heat and a heat generation portion for generating heat, said heat absorption portion being arranged on said semiconductor detection element side of said vacuum vessel; and a housing which comprises a transparent portion capable of passing the light to be incident on said photoelectric surface, and a voltage introduction terminal capable of supplying, to said photodetecting section, a voltage to be applied between said photoelectric surface and said electron incident surface, and accommodates at least part of said vacuum vessel, wherein said heat generation portion of said cooling means is fixed at a predetermined position on an inner surface of said housing, and said heat absorption portion is disposed between said vacuum vessel and said housing such that heat from said semiconductor detection element and heat from said photoelectric surface are absorbed by said heat absorption portion through said vacuum vessel.

2. A photodetecting device according to claim 1, characterized in that said housing further comprises a vacuum port for setting a vacuum state in said housing.

3. A photodetecting device according to claim 1, characterized in that said housing further comprises a gas introduction port for introducing and sealing a dry inert gas having a pressure lower than atmospheric pressure in said housing.

4. A photodetecting device according to claim 1, characterized in that said housing further comprises radiation means for radiating heat, said radiation means being arranged at the predetermined position where said heat generation portion of said cooling means is fixed.

5. A photodetecting device according to claim 1, characterized in that said vacuum vessel comprises an incident surface plate which passes the light and has said photoelectric surface arranged on one surface, a detection element fixing plate opposing said incident surface plate and having said semiconductor detection element arranged thereon, and a side tube which forms a vacuum space together with said incident surface plate and said detection element fixing plate.

6. A photodetecting device according to claim 5, characterized in that said side tube and said detection element fixing plate are formed from a ceramic material.

7. A photodetecting device according to claim 1, characterized in that said cooling means comprises a Peltier element.

8. An image sensing apparatus characterized by comprising said photodetecting device of claim 1.

* * * * *